US006551076B2

(12) United States Patent
Boulware

(10) Patent No.: US 6,551,076 B2
(45) Date of Patent: Apr. 22, 2003

(54) FUEL/HYDRAULIC ENGINE SYSTEM

(76) Inventor: Jim L. Boulware, 1204 N. Stope, Carrollton, TX (US) 75007

( * ) Notice: Subject to any disclaimer, the term of this patent is extended or adjusted under 35 U.S.C. 154(b) by 0 days.

(21) Appl. No.: 09/736,786

(22) Filed: Dec. 15, 2000

(65) Prior Publication Data

US 2002/0076339 A1 Jun. 20, 2002

(51) Int. Cl.[7] ..... F04B 17/00; F04B 35/00

(52) U.S. Cl. ..... 417/380; 417/381; 417/390; 60/407

(58) Field of Search ..... 417/380, 381, 417/364, 570, 390, 391, 399; 60/410, 413, 407

(56) References Cited

U.S. PATENT DOCUMENTS 3,610,215 A * 10/1971 Carter ..... 123/46 R
4,040,772 A * 8/1977 Caldarelli ..... 417/364
4,115,037 A * 9/1978 Butler ..... 417/341
4,326,380 A * 4/1982 Rittmaster et al. ..... 60/595
4,382,748 A * 5/1983 Vanderlaan ..... 417/11
4,435,133 A * 3/1984 Meulendyk ..... 417/364
4,599,861 A * 7/1986 Beaumont ..... 60/595
4,606,708 A * 8/1986 Clark ..... 417/380
4,674,280 A * 6/1987 Stuhr ..... 60/413
5,203,680 A * 4/1993 Waldrop ..... 417/364
5,261,797 A * 11/1993 Christenson ..... 417/380
5,461,861 A * 10/1995 Wenzel ..... 60/618
5,556,262 A * 9/1996 Achten et al. ..... 417/364
5,647,734 A * 7/1997 Milleron ..... 417/380
5,702,238 A * 12/1997 Simmons et al. ..... 417/380
5,829,393 A * 11/1998 Achten et al. ..... 123/36 A

* cited by examiner

*Primary Examiner*—Charles G. Freay
*Assistant Examiner*—Han L. Liu
(74) *Attorney, Agent, or Firm*—John E. Vandigriff

(57) ABSTRACT

An engine type apparatus converts the energy released by the internal combustion of a hydrocarbon fuel directly into high pressure. A power cylinder is physically located opposite one of a gas or liquid work cylinder. The power piston is coupled directly to either the gas/liquid work piston. Gas/liquid, under low pressure, enters the work cylinder to cause the coupled pistons to move and generate the compression stroke. The ignition of compressed fuel and air forces the coupled pistons in the opposite direction and the trapped gas/liquid travels through a one-way valve into one or more high-pressure accumulator(s). The pressure of the gas/liquid drives a pneumatic/hydraulic motor to accomplish work. The process is controlled by load requirements to create an "energy on demand" system.

16 Claims, 3 Drawing Sheets

FUEL/HYDRAULIC ENGINE SYSTEM

FIELD OF THE INVENTION

The invention is an apparatus for converting the energy in hydrocarbon fuel directly into high-pressure gas or liquid wherein the conversion is performed on demand from a load.

BACKGROUND OF THE INVENTION

The invention was conceived while trying to determine a way of transferring energy to the rear wheels of a vehicle, without the losses of a mechanical drive train. Hydraulics was viewed as the best method of accomplishing the task and this led to looking for a way of generating the pressure. Connecting the hydraulic piston directly to the power piston was obviously one way, but the concept of using low-pressure for the compression stroke was the idea that finalized its operation as an engine. It has been determined that multiple high-pressure accumulators may be incorporated to increase efficiency. Gases such as air may replace the hydraulic fluid for power transmission.

U.S. Pat. No. 6,024,067, describes an internal combustion engine which has it piston align, along a line, with a piston for a compressor.

U.S. Pat. No. 3,932,989, describes a system that uses a rotary drive engine which uses a combustion engine, and a hydraulic system for energy conversion. Fluid under pressure is delivered from the hydraulic chambers to a control valve to actuate a turbine.

U.S. Pat. No. 3,335,640, describes a reciprocating piston type engine providing the power to drive a hydrostatic movement converter.

SUMMARY OF THE INVENTION

The invention is a fuel engine apparatus designed to convert the energy released by the internal combustion of a hydrocarbon fuel directly into a high pressure gas or fluid collected in an accumulator. A power cylinder is physically located opposite either a gas or liquid work cylinder. The power piston is coupled directly to either the gas or liquid work piston. Gas or liquid, under low pressure, enters the work cylinder to cause the coupled pistons to move and generate the compression stroke. The ignition of the compressed fuel and air forces the coupled pistons in the opposite direction and the trapped gas or liquid travels through one or more one-way valve(s) into one or more high-pressure accumulator(s). The pressure is used to drive a pneumatic or hydraulic type motor or piston to accomplish work. The process is controlled by load requirements to create an "energy on demand" system.

BRIEF DESCRIPTIONS OF THE DRAWINGS

Figure 1:
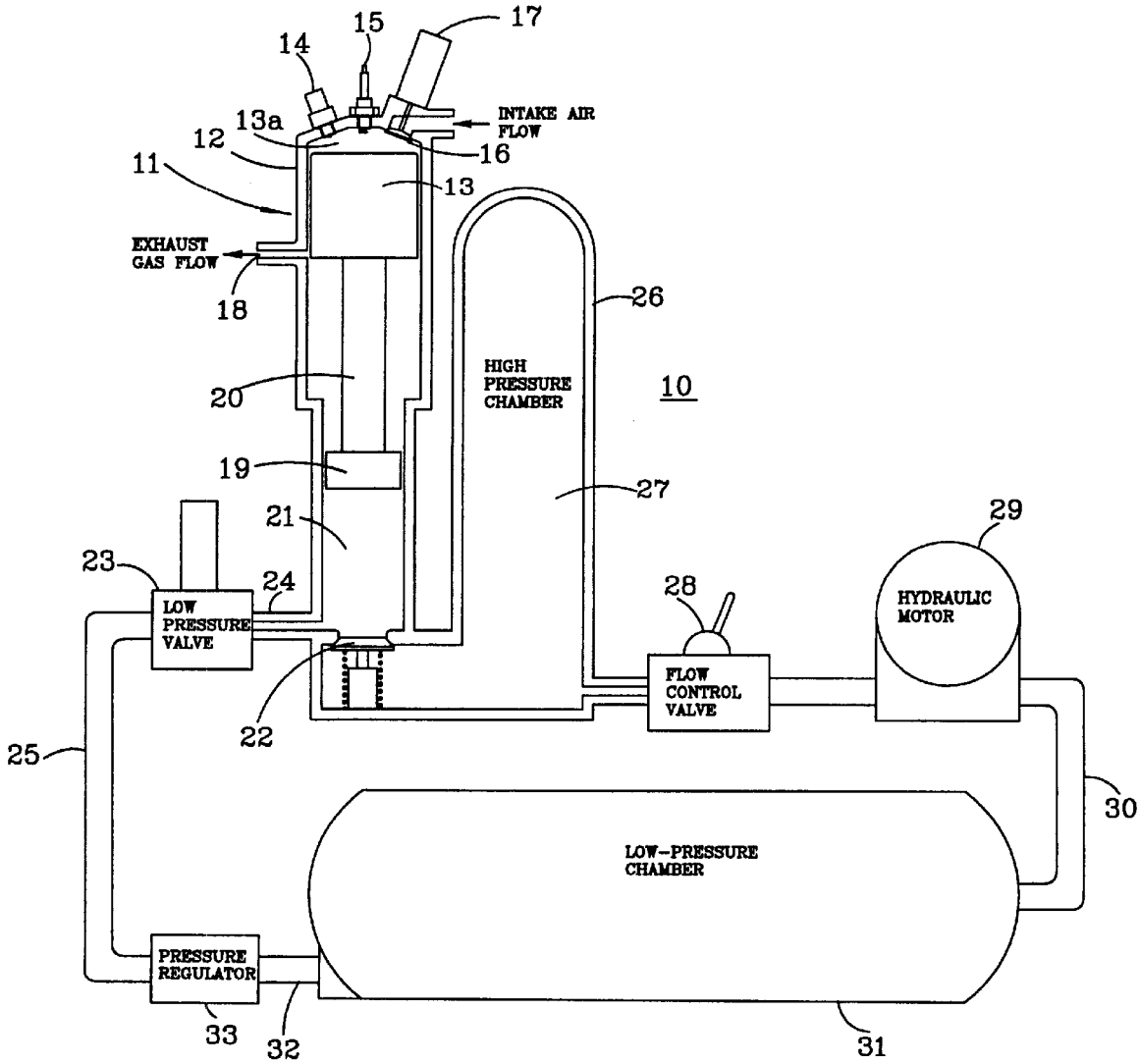
Figure 2:
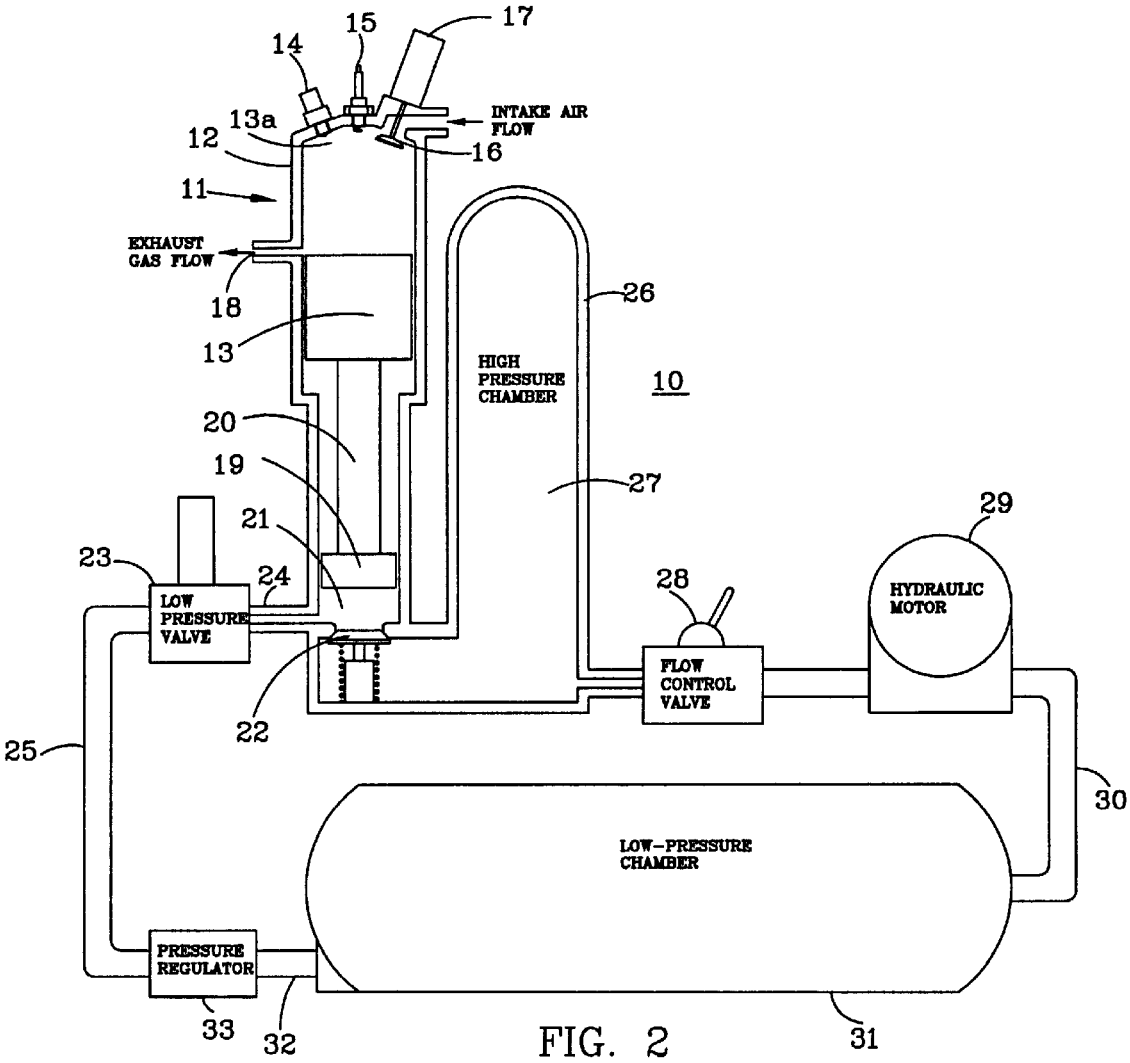
Figure 3:
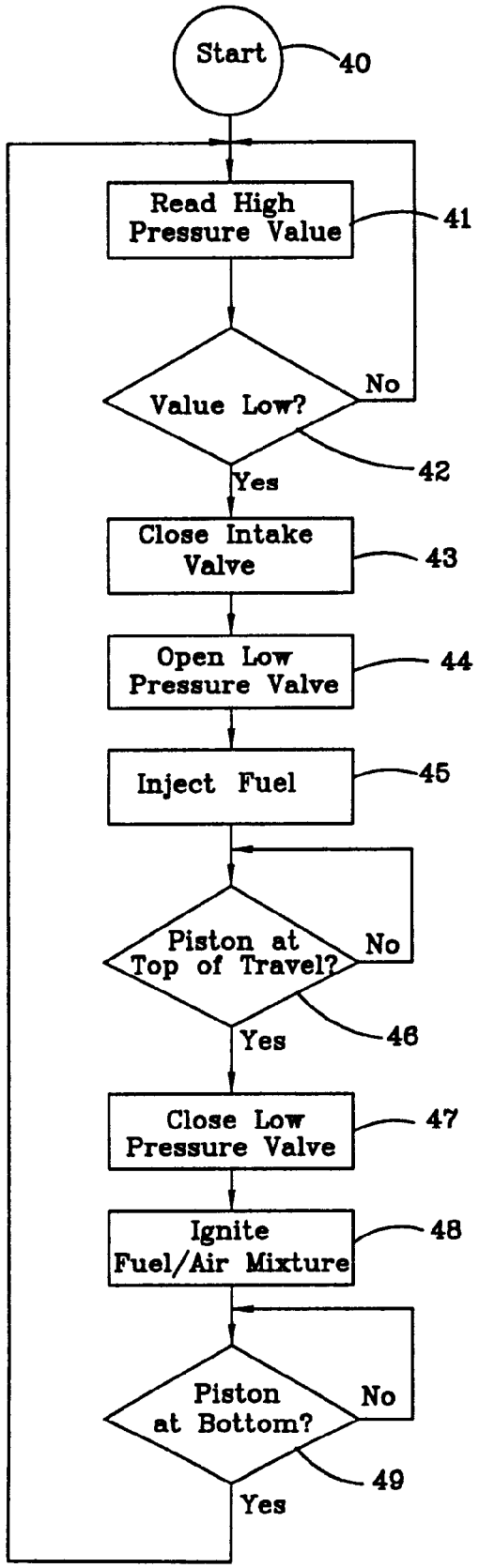

FIG. 1 shows a fuel engine/hydraulic system with the fuel engine piston in an upward compression position; and FIG. 2 shows the fuel engine/hydraulic system with the fuel engine piston in a downward idle position; and FIG. 3 is a flow diagram of control cycle of the engine system.

DESCRIPTION OF A PREFERRED EMBODIMENT

FIGS. 1 and 2 illustrate a fuel/hydraulic system 10 according to the invention. It is an engine type apparatus designed to convert the energy released by the internal combustion of a hydrocarbon fuel directly into high pressure. System 10 includes a fuel engine 11 having a cylinder 12 and piston 13. Engine 11 includes fuel injector 14, a spark plug 15, and intake valve 16 controlled by intake solenoid 17. Fuel engine piston 13 is physically located and attached by shaft 20 to hydraulic work piston 19. There are two pressure accumulators 26 and 31. The low-pressure accumulator 31 is used to maintain a pressure to drive the pistons 13, 19 on the compression stroke. The high-pressure accumulator 26 is used to accumulate the hydraulic fluid during the power stroke. The valves 22, 23 and 28 are used to control the hydraulic fluid flow and are explained in the following description.

Pistons 13 and 19, in FIG. 2, are shown in the idle state, which is where they will remain until the load requires energy generation. The intake valve 16 is open, allowing a new charge of air to be forced or pulled into the chamber 13*a*. The combustion chamber 13*a* is shown in a configuration similar to a two-cycle gasoline engine. The downward movement of the piston 13 uncovers the exhaust port 18, allowing the burned gases to escape. However an exhaust valve (not illustrated) may be designed in the head to allow the burned gases to exit. The intake and exhaust valves may be designed to be controlled by the piston's movement or position.

A cycle begins when the control electronics senses the high-pressure value is low. The level is based on predetermined conditions of load requirements and efficiency. The intake valve 16 is closed and the low-pressure valve 23 is opened allowing the hydraulic fluid under low-pressure to enter the work cylinder chamber 21 causing the coupled pistons 13, 19 to move upward and compress the air trapped in the power cylinder chamber 13*a* (FIG. 1). During the compression stroke, the fuel is injected directly vias injector 14 into the power cylinder chamber 13*a* with the amount and timing controlled by the electronics.

When the pistons 13, 19 have reached the point where the fuel and air mixture has been compressed to the desired ratio, the low-pressure valve 23 is closed and the spark plug 15 is fired which ignites the air and fuel mixture. The timing of the low-pressure valve 23 and spark plug 15 are also controlled by the electronics. The pressure generated by the burning fuel forces the coupled pistons 13, 19 in the opposite direction, as shown in FIG. 2, and the trapped hydraulic fluid travels through one-way valve 22 into the high-pressure accumulator 26.

The pressure is used to drive, through flow control valve 28, hydraulic type motor 29 to perform work in the form of rotary motion. The high pressure can also be applied to a piston to produce work in the form of linear motion. The spent hydraulic fluid flows through pipe 30 to low pressure chamber 31, out of low pressure chamber 31 through pipe 32 to an optional pressure regulator 33, and then through pipe 25 back to low pressure valve 23. The hydraulic fluid then flows into chamber 21 through pipe 24 to drive the pistons during the next cycle when fuel engine is again fired to force the hydraulic fluid into chamber 26 through valve 22.

FIG. 3 is a flow diagram of control cycle of the engine system. The system (FIG. 1) is initialized at 40 and the high pressure value in chamber 26 is read (41). If the pressure is not low (42) then another reading is taken (41) of the pressure until the value is low (42). When the value of the pressure is low, then the intake valve 16 is closed (43) and the low pressure valve 23 is opened (44) and fuel is injected (45) via fuel injector 14. It is then determined if piston 13 is at its top of desired travel position in cylinder 12. A check is made (46) until piston 13 is at its top of travel, then low pressure valve 23 is closed (47). The fuel in chamber 13*a* is ignited (48) to move pistons 13 and 19 downward to force liquid/gas into high pressure chamber 27 via valve 22. When piston 19 is at the bottom or lowest position (49), then the cycle is repeated (41). The cycle is repeated as long as the engine is running to provide liquid/gas to drive motor 29.

EXAMPLE OF THE INVENTION

The following calculations are given by way of example to show operating parameters of the invention.

The following assumptions about the internal combustion parameters are given since piston 13 is stationary when the fuel is ignited as opposed to a reciprocating engine and will have different pressure curves. The following calculations for the hydraulic engine are given as an example.

Parameters of the system: a 3 inch diameter for the internal combustion piston, a 2.5 inch diameter hydraulic piston, with a 3 inch stroke on pistons, an equivalent compression ratio of 8:1 and 500 PSI pressure in combustion cylinder at the end of stroke.

The total downward force on the combustion and hydraulic pistons would therefore be equal to: $1.5^2 \times 3.14 \times 500 = 3532.5$ pounds. This force on the hydraulic piston will generate: $3532.5/(1.25^2 \times 3.14) = 720$ PSI maximum.

For a compression ratio of 8:1 the force upward required on the combustion piston will be: $14.69 \times 1.5^2 \times 3.14 \times 8 = 830.3$ pounds.

To generate this force the low-pressure must be equal to: $830.3/(1.25^2 \times 3.14) = 169.3$ PSI minimum. This leaves a difference of pressure across the hydraulic motor of: $720 - 169.3 = 550.7$ PSI.

A Parker hydraulic motor, part number 4Z770, will produce approximately 244 in.-Lb torque at 641 RPM with a hydraulic pressure of 550.7 PSI and a flow rate of 10 gallons per minute. This is equivalent to approximately 3.21 horsepower.

Ten gallons per minute converts to 2310 cubic inches per minute. The hydraulic cylinder has a volume of: $1.25^2 \times 3.14 \times 3 = 14.72$ cubic inches. Therefore the number of ignitions/cycles to generate this volume is: $2310/14.72 = 157$ cycles per minute.

Other improvements become obvious for improving the output, for instance if the exhaust gas pressure was used to regenerate the hydraulic low-pressure, then the pressure difference would be 720 psi and the equivalent horsepower would increase to 4.2 horsepower. If the skirt of the hydraulic piston also formed a valve to allow collecting one-half of the hydraulic fluid to be collected at twice the above pressure, the equivalent horsepower would then increase to 6.3 horsepower. These increases would require no additional energy.

These cycle rates can be achieved with commercially available solenoid valves. However, if the cycle rate increases by a factor of 6 with valves operated by the piston movement the cylinder would produce between $6 \times 3.21 = 19.26$ and $6 \times 6.3 = 37.8$ equivalent horsepower.

What is claimed is:

1. A fuel engine apparatus for converting the energy in fuel directly into high-pressure gas, comprising:

a power piston coupled directly to a gas work piston;

a high-pressure accumulator to accumulate the high-pressure gas, through a one-way valve, generated by the combustion of the air-fuel mixture;

a pneumatic load powered by the high-pressure gas; and a low-pressure accumulator to supply low-pressure gas, through a cut-off valve for driving the pistons to compress the air-fuel mixture.

2. The fuel engine apparatus according to claim 1, including a pressure regulator between the low-pressure accumulator and the cut-off valve.

3. The fuel engine apparatus according to claim 1, including a flow control valve supplying high-pressure gas to a pneumatic load, and, wherein the low-pressure gas is generated from the residual energy in the exhaust.

4. The fuel engine apparatus according to claim 1, wherein the power piston and gas work piston convert the energy in fuel directly into high-pressure gas on demand from a load.

5. A fuel engine apparatus for converting the energy in fuel directly into high-pressure gas, comprising:

a power piston coupled directly to a gas work piston;

multiple high-pressure accumulators to accumulate varying values of high-pressure gases, through a one-way valve for each high-pressure accumulator, generated by the combustion of the air-fuel mixture;

a pneumatic load powered by the high-pressure gas; and a low-pressure accumulator to supply low-pressure gas through a cut-off valve for driving the pistons to compress the air-fuel mixture.

6. The fuel engine apparatus according to claim 5, including a pressure regulator between the low-pressure accumulator and the cut-off valve.

7. The fuel engine apparatus according to claim 5, including a flow control valve supplying high-pressure gas to a pneumatic load, and, wherein the low-pressure gas is generated from the residual energy in the exhaust.

8. The fuel engine apparatus according to claim 5, wherein the power piston and gas work piston converts the energy in fuel directly into high-pressure gas on demand from a load.

9. A fuel engine apparatus for converting the energy in fuel directly into high-pressure liquid, comprising:

a power piston coupled directly to a liquid work piston;

a single high-pressure accumulator to accumulate a high-pressure liquid, through a one-way valve, generated by the combustion an air-fuel mixture;

a liquid load powered by the high-pressure liquid; and a low-pressure accumulator to supply low-pressure liquid through a cut-off valve for driving the pistons to compress the air-fuel mixture.

10. The fuel engine apparatus according to claim 9, including a pressure regulator between the low-pressure accumulator and the cut-off valve.

11. The fuel engine apparatus according to claim 9, including a flow control valve supplying high-pressure liquid to a liquid load, and, wherein the low-pressure gas is generated from the residual energy in the exhaust.

12. The fuel engine apparatus according to claim 9, wherein the power piston and liquid work piston converts the energy in fuel directly into high-pressure fluid on demand from a load.

13. An engine type apparatus for converting the energy in fuel directly into high-pressure liquid, comprising of:

a power piston coupled directly liquid work piston;

multiple high-pressure accumulators which is used to accumulate the high-pressure liquid, through a one-way valve for each high-pressure accumulator, generated by the combustion of the air-fuel mixture;

a liquid load powered by the high-pressure liquid; and a low-pressure accumulator which is used to supply low-pressure liquid through a cut-off valve for driving the pistons to compress the air-fuel mixture.

14. The fuel engine apparatus according to claim 13, including a pressure regulator between the low-pressure accumulator and the cut-off valve.

15. The fuel engine apparatus according to claim 13, including a flow control valve supplying high-pressure liquid to a liquid load, and, wherein the low-pressure liquid is generated from the residual energy in the exhaust.

16. The fuel engine apparatus according to claim 13, wherein the power piston and liquid work piston converts the energy in fuel directly into high-pressure liquid on demand from a load.

* * * * *